United States Patent [19]

Aghnides

[11] 4,153,204

[45] May 8, 1979

[54] AERATOR WITH METAL CASING HAVING INNER PLASTIC ELEMENTS MOLDABLE IN ONE PIECE

[76] Inventor: Elie P. Aghnides, 795 Fifth Ave., New York, N.Y. 10021

[21] Appl. No.: 742,491

[22] Filed: Nov. 17, 1976

Related U.S. Application Data

[63] Continuation-in-part of Ser. No. 603,228, Aug. 8, 1975, abandoned.

[51] Int. Cl.[2] ..... E03C 1/084

[52] U.S. Cl. ..... 239/428.5; 239/590.3; 239/DIG. 18

[58] Field of Search ..... 239/428.5, 553–553.5, 239/590–590.5, DIG. 18, 575

[56] References Cited

U.S. PATENT DOCUMENTS

| | | | |
|---|---|---|---|
| Re. 25,447 | 9/1963 | Hjulian | 239/428.5 X |
| 2,664,278 | 12/1953 | Aghnides | 239/428.5 |
| 2,738,798 | 3/1956 | Goodrie | 239/DIG. 18 |
| 2,787,452 | 4/1957 | Aghnides | 239/428.5 |
| 2,793,016 | 5/1957 | Aghnides | 239/428.5 |
| 2,799,487 | 7/1957 | Aghnides | 239/428.5 |
| 2,962,225 | 11/1960 | Aghnides | 239/428.5 |
| 2,998,925 | 9/1961 | Aghnides | 239/428.5 |
| 2,998,926 | 9/1961 | Aghnides | 239/428.5 |
| 2,998,927 | 9/1961 | Aghnides | 239/428.5 |
| 2,998,929 | 9/1961 | Aghnides | 239/428.5 |
| 2,998,931 | 9/1961 | Aghnides | 239/428.5 |
| 2,998,933 | 9/1961 | Aghnides | 239/428.5 |
| 3,067,951 | 12/1962 | Aghnides | 239/428.5 |
| 3,104,827 | 9/1963 | Aghnides | 239/428.5 |
| 3,130,917 | 4/1964 | Aghnides | 239/428.5 |
| 3,130,918 | 4/1964 | Aghnides | 239/428.5 |
| 3,198,440 | 8/1965 | Aghnides | 239/428.5 |
| 3,224,793 | 12/1965 | Benjamin | 239/428.5 |
| 3,232,541 | 2/1966 | Aghnides | 239/428.5 |
| 3,270,964 | 9/1966 | Aghnides | 239/428.5 |
| 3,270,965 | 9/1966 | Aghnides | 239/428.5 |
| 3,275,246 | 9/1966 | Aghnides | 239/428.5 |
| 3,362,648 | 1/1968 | Aghnides | 239/428.5 |
| 3,363,841 | 1/1968 | Aghnides | 239/428.5 |
| 3,450,350 | 6/1969 | Gullaksen | 239/428.5 |
| 3,533,554 | 10/1970 | Mongerson | 239/428.5 X |
| 3,635,405 | 1/1972 | Shames et al. | 239/428.5 |
| 3,712,548 | 1/1973 | Aghnides | 239/428.5 |
| 3,811,619 | 5/1974 | Aghnides | 239/428.5 |
| 3,827,636 | 8/1974 | Parkison et al. | 239/428.5 |

FOREIGN PATENT DOCUMENTS

| | | | |
|---|---|---|---|
| 1596242 | 7/1970 | France | 239/428.5 |
| 986142 | 3/1965 | United Kingdom | 239/428.5 |
| 1189550 | 4/1970 | United Kingdom | 239/428.5 |

*Primary Examiner*—Robert B. Reeves
*Assistant Examiner*—Andres Kashnikow
*Attorney, Agent, or Firm*—William D. Hall; Geoffrey R. Myers

[57] ABSTRACT

An aerator for use on water faucets having a metal casing and a one-piece plastic insert that includes both the diaphragm for directing a large number of water jets in a downstream direction and a ledge for holding a screen to mix said water jets with air. The one-piece molded plastic insert is held in the casing due to compression between the downstream end of the faucet and an inturned ledge or lip at the downstream end of the metal casing. The one-piece insert defines air intake passageways passing along the inside wall of the casing and entering the mixing space between the diaphragm and the screen. The plastic material is soft enough so that the upper end of the one-piece plastic insert makes a substantial seal with the faucet. If some water does pass this seal, it enters the air intake passageways and passes out the downstream end of the casing. Slits are provided in the side wall of the insert to enhance the molding of the insert.

27 Claims, 6 Drawing Figures

AERATOR WITH METAL CASING HAVING INNER PLASTIC ELEMENTS MOLDABLE IN ONE PIECE

RELATED APPLICATION

This application is a continuation-in-part of my prior copending application Ser. No. 603,228, filed Aug. 8, 1975, entitled "Aerator With Metal Casing Having Inner Plastic Moldable In One Piece", now abandoned.

BACKGROUND OF THE INVENTION

Aerators molded in one piece are well known, for example, my U.S. Pat. Nos. 3,363,841, entitled Molded Water Aerators, granted Jan. 16, 1968, and 3,270,964, entitled Molded Water Aerator, granted Sept. 6, 1966, show all of the parts of an aerator, including the casting molded in one piece, except that the metal screens are separate and may be readily inserted into the molded aerator. It is desirable, however, in some cases, to use a metal casing for the aerator, and, consequently, there are a number of my prior patents which show such a casing with molded inserts capable of receiving a screen; see, for example, my U.S. Pat. Nos. 2,799,487 - "Aerator With Unitary Molded Inner Assembly", granted July 16, 1957; 2,998,929 - "Water Aerators", granted Sept. 5, 1961; 3,130,917 - "Water Aerator Having Improved Pre-Aerating Disc", granted Apr. 28, 1964; 3,130,918- "Slotless Aerator", granted Apr. 28, 1964; 3,270,965 - "Self-Sealing and Deposit-Proof Aerator", granted Sept. 6, 1966; British Pat. No. 1,189,550, published Apr. 29, 1970; Italian Pat. No. 854,515, granted Jan. 15, 1970; and French Pat. No. 1,596,242, delivered 15 June 1970. The aforesaid patents, however, do not disclose a one-piece insert capable of being molded at the lowest possible price and providing all of the advantages which an aerator is capable of providing. Very satisfactory aerators utilizing an imperforate cylindrical casing containing both metal and plastic parts are well known; see, for example, my U.S. Pat. No. 2,998,927 entitled "Fluid Mixing Devices", granted Sept. 5, 1961. These devices, however, do not have the cost-saving advantage of a single one-piece molded insert. Moreover, they do not have the advantage of a simplified assembly, nor do they have the advantage of ease of cleaning which allows the insert to be taken out, cleaned, and put back in the metal casing as is the case in my present invention.

It is, therefore, an object of my invention to provide such an aerator-adapted to be attached to the spout end of a faucet-which comprises a metal casing and a low cost one-piece insert for the casing.

It is another object of my invention to provide devices as set forth in the preceding object in which the aerating function is carried out with a very high degree of efficiency.

Still another object of my invention is to provide an aerator that overcomes any problem of leakage between the faucet and the aerator.

Yet an additional object of the invention is to provide an aerator which may not require a washer between the aerator and the faucet.

A further object of my invention is the provision of a plastic aerator insert formed in one piece, which is easily moldable and requires a minimum amount of plastic material.

SUMMARY OF THE INVENTION

My new aerator employs a metal casing having threads at the upstream end for attaching it to the faucet. The casing is cylindrical in shape and has a small inturned ledge or lip at its downstream end.

A generally cylindrical one-piece plastic insert snugly fits in said casing and has an upstream cylindrical portion, the upstream end of which engages the downstream end of the faucet when the aerator is screwed onto the faucet. This insert also has ribs, the downstream end of which rests on said led so that the one-piece insert is compressed between the downstream end of the faucet and the ledge. The insert is of material soft enough, such as delrin f.i., to form a substantial seal with the downstream end of the faucet when the aerator is compressed as aforesaid.

The one-piece insert has an upstream perforated disc having at least one water discharge opening to thus increase the velocity of the water while decreasing its cross-section. The aforesaid ribs are integral with said perforated disc and are spaced apart. The ribs support and are integral with a ring, the upstream end of which is spaced from the downstream end of said disc to thus allow the air to enter the mixing space. Moreover, the downstream end of said ring includes means, such as a ledge, for receiving the mixing screen.

Downstream of said disc is a mixing space fed with air by an air delivery path. This air delivery path is defined by the inner wall of said casing and the outer wall of the ring, and extends between each pair of ribs.

There are slits extending from the downstream ends of the ribs upstreamwardly to the downstream end of the upstream disc. These slits extend not only through the ribs but also through the wall that comprises said ring (which receives the screen). These slits are sufficiently narrow to impair water flow through them. They enhance removal of the plastic insert from the mold. Air may, however, enter through said slits.

Moreover, the ribs extend further downstream than said ring, to maximize flow of air into the aerator. The lowermost part of said ring is preferably spaced upstream of the upstream side of said ledge so that air may freely enter the air delivery path. However, the lowermost end of the ring may be as low as the upstream side of the ledge if the latter comprises a series of spaced teeth.

The space between said cylindrical portion and the inner side wall of the casing communicates with said air-delivery path so that if small amounts of water do pass said substantial seal, such water will pass along the inside wall of the casing and be deflected by said ledge towards the main body of water leaving the aerator.

DETAILED DESCRIPTION OF THE INVENTION

Figure 1:
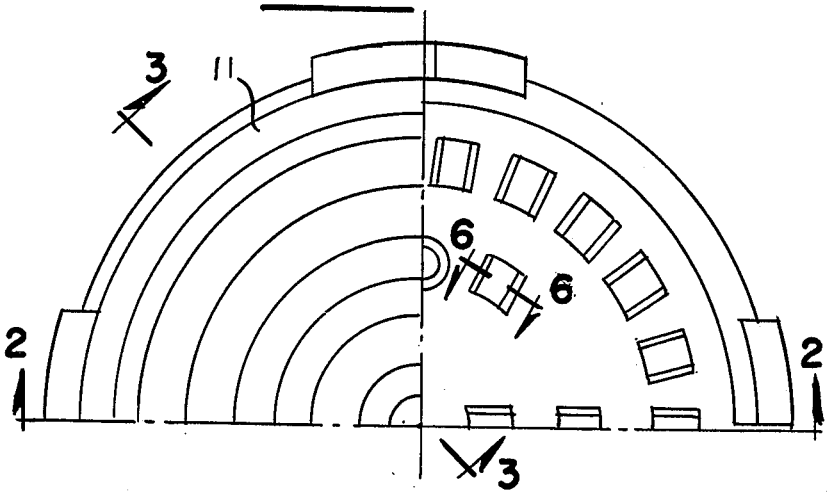
FIG. 1 is a top view of the one-piece plastic insert which forms a part of the invention.
Figure 6:
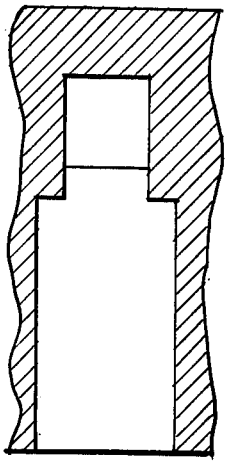
FIG. 6 is a cross-sectional view of FIG. 1 taken along lines 6—6.
Figure 2:
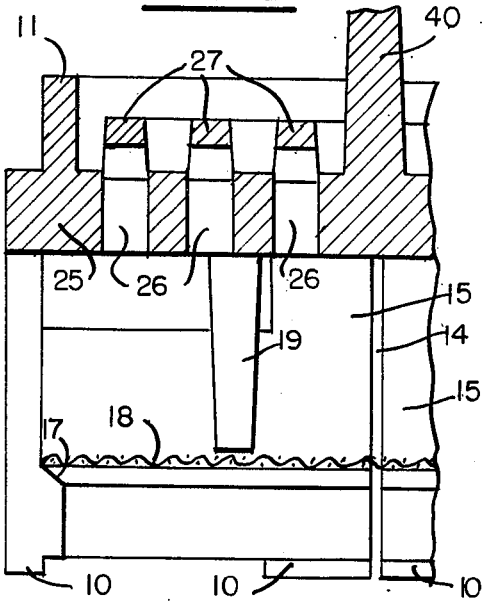
FIG. 2 is a cross-sectional view of FIG. 1 taken along the lines of 2—2, FIG. 1.
Figure 3:
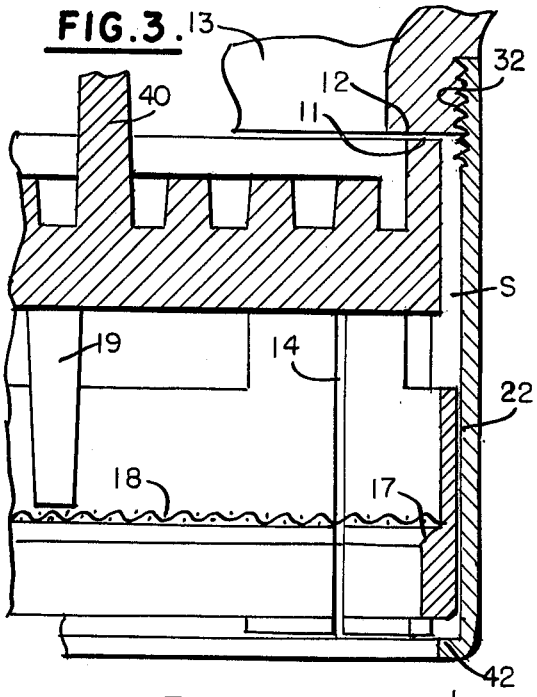
FIG. 3 is a cross-sectional view taken along lines 3—3 of FIG. 1.
Figure 5:
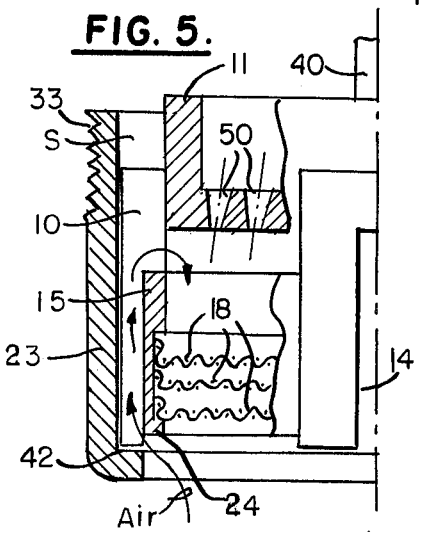
FIG. 5 is a cross-sectional view of a modified form of aerator in which the perforations of the disc are conical.

The aerator has a metal casing having threads at its upstream end and an inturned lip at its downstream end. An example of such casing where the threads are on the inner wall and casing is shown in FIG. 3 where the casing 22 is provided with internal threads 32 and an inturned downstream ledge or lip 42. Another example of the casing is shown in FIG. 5 where the casing 23 has external threads 33 near its upstream end and an inturned ledge or lip 42 at its downstream end. The casings of both FIGS. 3 and 5 are preferably cylindrical and imperforate along their side walls.

Figure 4:
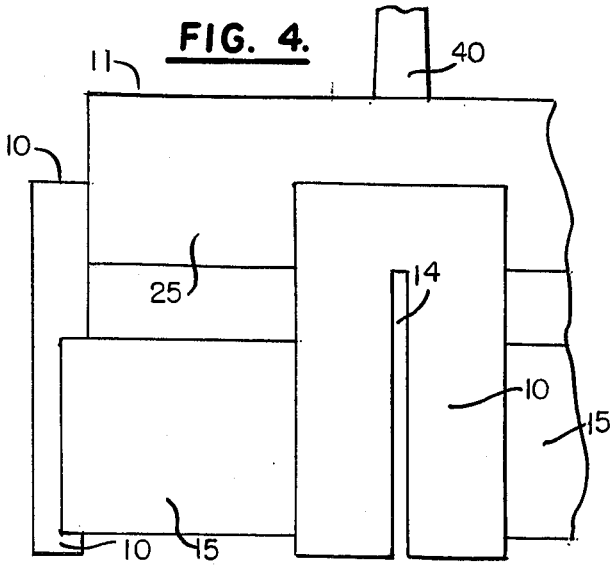
FIG. 4 is a side view of the plastic insert.

One form of the one-piece plastic insert is shown in FIGS. 1, 2, 3, 4, and 6, for example. As shown in FIG. 4, the one-piece plastic insert is generally cylindrical in shape and has a handle 40 projecting upstreamwardly from the insert to enable easy removal of the insert from the casing.

The one-piece plastic insert also includes a cylindrical upstream portion 11 of slightly smaller diameter than the inside wall of the casing. The cylindrical portion 11 is integral with the disc portion 25 which in turn is integral with the ribs 10. There is, moreover, a lower cylindrical portion 15 integral with the ribs 10, which portion includes a ledge 17 for supporting screen 18 which is prevented from moving upwardly by the projections 19 which are integral with the disc 20. The disc 25 has perforations 26 for directing a plurality of water jets at the screen 18.

The efficiency of aeration may be improved by incorporating a bridge 27 such as is shown and described in my aforesaid U.S. Pat. No. 3,363,841 - "Molded Water Aerators", granted Jan. 16, 1968, or other turbulent generating means such as described in other of my patents, such as my other U.S. Pat. No. 2,998,929 - "Water Aerators", granted Sept. 5, 1961, or such as described in my U.S. appln. Ser. No. 669,112 filed Mar. 22, 1976. By incorporating such a bridge 27 integral with the remainder of the one-piece plastic insert, the water jets are appropriately conditioned so that upon striking the screen 18 a very efficient aerating function occurs, thereby reducing the number of screens 18 that are needed for best operation of the aerator. The inlet air enters around the inner wall of the ledge 42, proceeds upstreamwardly between the ribs 10 and enters the mixing space between the cylindrical disc 25 and the cylindrical portion 15 of the aerator. While I have referred to the fact that the upstream end of the plastic insert creates a substantial seal against the downstream end of the metal faucet 13, it is understood that this seal may not be perfect and that, therefore, there may be some leakage of water through the seal. If this should occur, a washer may be seated above portion 11, otherwise such water enters the space S between the outer wall of the cylindrical portion 11 and the inner wall of casing 22 and flows downstreamwardly towards the main body of the water leaving the aerator. As a result, leakage between the aerator casing 22 and the faucet 13 is avoided. In the modified form of FIG. 5, the casing has external threads 33, but the downstream end of the faucet has an inside ledge against which the cylindrical portion 11 may abut to constitute the substantial seal described above. A somewhat similar arrangement for attaching an aerator having external threads to a faucet is shown in several of my prior patents, for example, see U.S. Pat. No. 3,270,965 entitled Self Sealing and Deposit Proof Aerator, granted Sept. 6, 1966; U.S. Pat. No. 3,104,827, entitled Vandal-Proof Aerator, granted Sept. 24, 1963; U.S. Pat. No. 2,998,929, entitled Water Aerators, granted Sept. 5, 1961; and my aforesaid British, Italian and French patents, The aerator of FIG. 5 may have inverted cones 50 in place of the perforations 26 and may have a plurality of screens 18 instead of the single screen 18 of FIG. 2. Otherwise, the aerators of FIGS. 1, 2, 3, and 4 on the one hand and FIG. 5 on the other hand are similar. In FIGS. 1 through 4 and 6, the perforations 26, of diaphragm 25 have a square or arcuated cross-section, as taught in my aforesaid prior U.S. Pat. No. 3,130,917.

To enhance the effectiveness of molding the plastic insert in one piece, it is desirable to provide a slit 14 in the ribs 10. In one form the slit extends from the downstream end of the insert to the lower level of the disc 25. In practice, it has been found that when the slit is approximately 0.3 mm. to 0.5 mm. wide, the water will not flood the space between the inner wall of casing 23 and the outer wall of cylindrical portion 15.

Slit 14 allows the cylindrical portion 15 to move outwardly as the plastic insert is removed from the mold. To further enhance the removal of the plastic insert from the mold, the ledge 17, for the screen 18, is inclined as shown.

It is noted that ribs 10 extend downstreamwardly beyond the downstream end of cylindrical portion 15 to provide ample space between inturned ledge 42 and cylindrical portion 15 for a larger quantity of air to enter the aerator.

The casing 22 (or 23) may be made of plastic material, or of elastic material such as rubber instead of metal, in which event the downstream end of the casing may be distended and the insert placed in the casing through the opening in the downstream end thereof.

The lowermost end of cylindrical portion (ring) 15 should be positioned at least as far upstream as the upstream side of ledge 42.

If the lowermost end of ring 15 is at the same level as, or only slightly upstream of, the upstream side of ledge 42, that ledge should be constructed in the form of spaced teeth, as shown in my U.S. Patents:

U.S. Pat. No. 2,998,926, granted Sept. 5, 1961, entitled "Aerator With Improved Air Supply"

U.S. Pat. No. 2,998,927, granted Sept. 5, 1961, entitled "Fluid Mixing Devices"

U.S. Pat. No. 3,198,440, granted Aug. 3, 1965, entitled "Aerator Structure and Legged Diaphragm Therefor".

This permits air to enter between the teeth and pass between casing 23 and ring 15 to the mixing space downstream of the orifices 26 and/or 50.

I claim to have invented:

1. An aerator comprising a casing having threads at its upstream end for attaching the aerator to a faucet, said casing being cylindrical in shape and having an inturned ledge at its downstream end, a generally cylindrical one-piece plastic insert in said casing having a maximum outside diameter slightly smaller than the inside diameter of said casing, said one-piece insert having an upstream cylindrical portion which engages the faucet when the aerator is screwed onto the faucet, said upstream cylindrical portion including a perforated diaphragm across the path of flow to produce at least one high speed water jet directed in a downstream direction, said one-piece insert also comprising a plurality of spaced ribs that have downstream ends resting on said ledge and the upstream portions of said ribs being integral with said upstream cylindrical portion of said insert, thereby enabling the plastic insert to be compressed between the downstream end of the faucet and said ledge when the aerator is screwed onto a faucet, said one-piece plastic insert also having a plastic downstream cylindrical sleeve which is integral with the remainder of the insert and extends inside of said ribs and therefore spaced from the inner wall of the casing and also having its upstream end spaced downstreamwardly of said upstream cylindrical portion to thereby define an air path from the downstream end of the casing, through the spaces between said ribs and between the inner side wall of the casing and the outer side wall of the downstream cylindrical sleeve and then over the upstream end of the downstream cylindrical sleeve, and mixing means located in the downstream cylindrical sleeve, said downstream cylindrical sleeve having at least one slit extending upstreamwardly from its downstream end for a substantial distance.

2. An aerator as defined in claim 1 in which said downstream sleeve has a ledge extending inwardly, said mixing means resting on said ledge.

3. An aerator as defined in claim 1 in which said slit passes from the downstream end of one of said ribs and extends upstreamwardly through both said one rib and the downstream sleeve for a substantial distance.

4. An aerator as defined in claim 3 in which the slit extends upstreamwardly to the downstream end of the upstream cylindrical portion.

5. An aerator as defined in claim 4 in which said slit is about 0.3 mm. to 0.5 mm. wide.

6. An aerator as defined in claim 4 in which each rib has a slit therein extending from its downstream end upstreamwardly to the downstream end of the upstream cylindrical portion.

7. An aerator as defined in claim 6 in which each slit is about 0.3 mm. to 0.5 mm. wide.

8. An aerator as defined in claim 3 in which said slit is about 0.3 mm. to 0.5 mm. wide.

9. An aerator as defined in claim 1 in which the ribs extend farther downstreamwardly than said downstream cylindrical sleeve to thereby minimize the impedance of said cylindrical sleeve to flow of air into the aerator.

10. An aerator as defined in claim 1 in which the slit is about 0.3 mm. to 0.5 mm. wide.

11. An aerator as defined in claim 1 in which said downstream cylindrical sleeve has an inturned lip at its downstream end, said mixing means comprising a screen resting on said lip.

12. An aerator as defined in claim 1 in which said downstream cylindrical sleeve has an inturned lip at its downstream end, said mixing means comprising a screen resting on said lip, said screen having an upper surface, and a projection integral with said diaphragm and extending downstream therefrom to the upper surface of said screen to hold the screen in place.

13. An aerator as defined in claim 1 in which said upstream cylindrical portion that engages the faucet comprises a single solid cylindrical member projecting upstreamwardly from the diaphragm.

14. An aerator as defined in claim 13 in which said downstream cylindrical sleeve has an inturned lip at its downstream end, said mixing means comprising a screen resting on said lip, said screen having an upper surface, and a projection integral with said diaphragm and extending downstream therefrom to the upper surface of said screen to hold the screen in place.

15. An aerator comprising:

a casing having threads at its upstream end for attaching the aerator to a faucet, said casing being cylindrical in shape and having an inturned ledge at its downstream end, a generally cylindrical one-piece plastic insert in said casing and having a maximum outside diameter slightly smaller than the inside diameter of said casing, said one-piece insert having an upstream cylindrical portion which engages the faucet when the aerator is screwed onto the faucet, said upstream cylindrical portion including a perforated diaphragm across the path of flow to produce at least one high speed water jet directed in a downstream direction, said one-piece insert also comprising a plurality of spaced ribs that have downstream ends resting on said ledge and the upstream portions of said ribs being integral with said upstream cylindrical portion of said insert, thereby enabling the plastic insert to be compressed between the downstream end of the faucet and said ledge when the aerator is screwed onto a faucet, said one-piece plastic insert also having a plastic downstream cylindrical sleeve which is integral with the remainder of the insert and extends inside of said ribs and therefore spaced from the inner wall of the casing and also having its upstream end spaced downstreamwardly of said upstream cylindrical portion to thereby define an air path from the downstream end of the casing, through the spaces between said ribs and between the inner side wall of the casing and the outer side wall of the downstream cylindrical sleeve and then over the upstream end of the downstream cylindrical sleeve, and mixing means located in the downstream cylindrical sleeve, said ribs extending farther downstreamwardly than said cylindrical sleeve to thus reduce the impedance offered by the sleeve to the flow of air into said aerator.

16. An aerator as defined in claim 15 in which said ribs have slits extending from their downstream ends upstreamwardly for a substantial distance, said slits extending through both the ribs and the sleeve.

17. An aerator as defined in claim 16 in which each slit is no greater than 0.3 mm. to 0.5 mm. wide.

18. An aerator as defined in claim 16 in which the slits extend upstreamwardly to the downstream end of the upstream cylindrical portion.

19. An aerator as defined in claim 18 in which each slit is about 0.3 mm. to 0.5 mm. wide.

20. A faucet aerator comprising a casing having means at its upstream end to connect the casing to a source of water under pressure, said casing having an inner wall and also having an inturned ledge at its downstream end, a one-piece molded insert for said casing resting on said inturned ledge, comprising:

(a) a perforated disc for producing a plurality of high velocity streamlets in a downstream direction, (b) a ring, through which the water from said disc flows, having an outside wall the diameter of which is smaller than the inside wall of said casing and having its upper end spaced downstream of the downstream face of said disc, (c) A plurality of spaced supports extending from said ring upstreamwardly to said disc to support the disc, and (d) projections on the outer surface of the ring to space the outer wall of the ring from the inner wall of said casing to provide an air-delivery space that allows air flow upstreamwardly between the inner wall of said casing and the outer wall of the ring, and mixing means in said ring to aerate the water flowing through the ring, characterized by:

the lowermost part of said ring being located at least as far upstream as the upstream side of said ledge, said projections and said supports constituting ribs extending from said ledge to said disc, said ribs having slits extending from said ledge upstreamwardly at least above said ring so that air may enter said slits at said ledge and flow through the slits to said mixing space.

21. An aerator as defined in claim 20 in which said slits extend through both the ribs and the ring.

22. A faucet aerator comprising a casing having means at its upstream end to connect the casing to a source of water under pressure, said casing having an inner wall and also having an inturned ledge at its downstream end, a one-piece molded insert for said casing resting on said inturned ledge, comprising:

(a) a perforated disc for producing a plurality of high velocity streamlets in a downstream direction, (b) a ring, through which the water from said disc flows, having an outside walll the diameter of which is smaller than the inside wall of said casing and having its upper end spaced downstream of the downstream face of said disc, (c) a plurality of spaced supports extending from said ring upstreamwardly to said disc to support the disc, and (d) projections on the outer surface of the ring to space the outer wall of the ring from the inner wall of said casing to provide an air-delivery spaced that allows air flow upstreamwardly between the inner wall of said casing and the outer wall of the ring, and mixing means in said ring to aerate the water flowing through the ring, characterized by:

the lowermost part of said ring being located at least as far upstream as the upstream side of said ledge, said projections and said supports comprising ribs extending from the disc to said ledge, said ribs having slits therethrough, each of said slits being along a radii of the casing and extending upstreamwardly from the downstream end of the ribs.

23. An aerator as defined in claim 22 in which said slits are so narrow as to impair water flow therethrough.

24. An aerator comprising a casing having threads at its upstream end for attaching the aerator to a faucet, said casing being cylindrical in shape and having an inturned ledge at its downstream end, a generally cylindrical one-piece plastic insert in said casing having a maximum outside diameter slightly smaller than the inside diameter of said casing, said one-piece insert including a perforated diaphragm across the path of flow to produce at least one high speed water jet directed in a downstream direction, said one-piece insert also comprising a plurality of spaced ribs that have downstream ends resting on said ledge and the upstream portions of said ribs being integral with said diaphragm, said one-piece plastic insert also having a plastic downstream cylindrical sleeve which is integral with the remainder of the insert and extends inside of said ribs and therefore spaced from the inner wall of the casing and also having its upstream end spaced downstreamwardly of said diaphragm to thereby define an air path from the downstream end of the casing, through the spaces between said ribs and between the inner side wall of the casing and the outer side wall of the downstream cylindrical sleeve and then over the upstream end of the downstream cylindrical sleeve, and mixing means located in the downstream cylindrical sleeve, said downstream cylindrical sleeve having at least one slit extending upstreamwardly from its downstream end for a substantial distance.

25. An aerator comprising:

a casing having threads at its upstream end for attaching the aerator to a faucet, said casing being cylindrical in shape and having an inturned ledge at its downstream end, a generally cylindrical one-piece plastic insert in said casing and having a maximum outside diameter slightly smaller than the inside diameter of said casing, said one-piece plastic insert including a perforated diaphragm across the path of flow to produce at least one high speed water jet directed in a downstream direction, said one-piece insert also comprising a plurality of spaced ribs that have downstream ends resting on said ledge and the upstream portions of said ribs being integral with said diaphragm, said one-piece plastic insert also having a plastic downstream cylindrical sleeve which is integral with the remainder of the insert and extends inside of said ribs and therefore spaced from the inner wall of the casing and also having its upstream end spaced downstreamwardly of said diaphragm to thereby define an air path from the downstream end of the casing, through the spaces between said ribs and between the inner side wall of the casing and the outer side wall of the downstream cylindrical sleeve and then over the upstream end of the downstream cylindrical sleeve, said mixing means located in the downstream cylindrical sleeve, said ribs extending farther downstreamwardly than said cylindrical sleeve to thus reduce the impedance offered by the sleeve to the flow of air into said aerator.

26. An aerator comprising:

a cylindrical casing having an outer wall and an innerr wall, said casing having an upstream end and a downstream end and including means to attach said upstream end to a source of water under pressure, a one piece plastic insert having an upstream disc portion extending across the path of water flow through said casing and having at least one opening therethrough to form at least one high velocity jet passing downstreamwardly, said one piece insert and said casing including means for holding said insert in said casing, said one piece insert also including a cylindrical sleeve portion downstream of said disc portion and having an outer diameter smaller than the diameter of said inner wall of said casing to form an air inlet passageway for said aerator, mixing means mounted in said cylindrical portion for mixing said high velocity jet with air, said mixing means being spaced downstream of said disc portion to form a mixing space, said one piece insert including a connecting portion integral with both said disc portion and said cylindrical portion for connecting said disc portion with said cylindrical portion, said connecting portion defining at least one opening to allow air to pass from said passageway to said mixing space, characterized by:

said cylindrical sleeve portion defining at least one slit extending parallel to the axis of said cylindrical sleeve portion and extending upstreamwardly from the downstream end of said cylindrical portion, the aggregate width of all such slits in said cylindrical sleeve portion being small as compared to the periphery of said cylindrical sleeve portion.

27. An aerator as defined in claim 26 in which each said slit is not greater than about 0.5 mm. wide.

* * * * *